United States Patent [19]

Weinerman et al.

[11] Patent Number: 4,679,835

[45] **Date of Patent: * Jul. 14, 1987**

[54] HALF TURN CABINET LATCH WITH THREE-PART PRIMARY OPERATING ELEMENT

[75] Inventors: Lee S. Weinerman, Medina; Joel T. Vargus, Middleburg Hts., both of Ohio

[73] Assignee: The Eastern Company, Strongsville, Ohio

[ * ] Notice: The portion of the term of this patent subsequent to Jun. 9, 2004 has been disclaimed.

[21] Appl. No.: 781,662

[22] Filed: Sep. 30, 1985

Related U.S. Application Data

[63] Continuation-in-part of Ser. No. 761,038, Jul. 31, 1985.

[51] Int. Cl.[4] ..... E05C 3/06

[52] U.S. Cl. ..... 292/197

[58] Field of Search ..... 292/57–69, 292/140, 240, 197

[56] References Cited

U.S. PATENT DOCUMENTS

| | | | |
|---|---|---|---|
| 19,588 | 3/1858 | Scripture | 292/58 |
| 366,756 | 7/1887 | Barnes | 292/58 |
| 1,907,625 | 5/1933 | Vogt | 292/DIG. 46 X |
| 2,269,264 | 1/1942 | Haim | 292/62 |
| 2,581,816 | 1/1952 | Schlueter | 292/240 X |
| 3,402,958 | 9/1968 | Barry | 292/62 |
| 4,556,244 | 12/1985 | Bisbing | 292/65 |

FOREIGN PATENT DOCUMENTS

| | | | |
|---|---|---|---|
| 68621 | 12/1929 | Sweden | 292/58 |

*Primary Examiner*—Richard E. Moore
*Attorney, Agent, or Firm*—David A. Burge

[57] ABSTRACT

A cabinet latch has a generally cylindrical body that is mountable on a closure panel or the like. A passage is formed through the body along a center axis, and opens through forward and rearward end regions of the body. Operating components are protectively nested within the body passage, including a primary operating element that is formed as a three-piece assembly including a generally cylindrical tool-receiving core and a pair of semi-circular sleeve halves that are journaled for rotation within the forward end region of the body passage. An elongate shank has a portion that projects from the rearward end of the body passage and carries a pawl. The shank and the pawl are rotatable about and movable axially along the center axis to position the pawl among unlatched, latched and latched-clamped positions for selectively releasing, retaining, and securely clamping the closure in a closed position relative to an associated cabinet or the like. Movement of the pawl is effected in response to rotation of the primary operating element, and is controlled by the interactive operating components that are carried within the body passage. A half turn rotation of the primary operating element in one direction of rotation causes the pawl to move in sequence (1) by rotating a quarter turn about the center axis from an unlatched position to a latched position, and (2) by translating axially along the center axis from the latched position to a latched-clamped position. A half turn rotation of the primary operating element in the opposite direction reverses the pawl's movements. A snap ring holds the operating components in place within the body.

22 Claims, 22 Drawing Figures

HALF TURN CABINET LATCH WITH THREE-PART PRIMARY OPERATING ELEMENT

CROSS REFERENCE TO RELATED APPLICATION

The present application is a continuation-in-part of co-pending application Ser. No. 761,038, filed July 31, 1985, entitled HALF TURN CABINET LATCH WITH DOOR GASKET CLAMPING CAPABILITY, hereinafter referred to as the "Parent Case," the disclosure of which is incorporated herein by reference.

BACKGROUND OF THE INVENTION

1. Field of the Invention

The present invention relates generally to a latch for securely releasably clamping closures such as access panels and doors of industrial cabinets, electrical equipment enclosures and the like in closed positions. More particularly, the present invention relates to a clamping type latch that has a body which is mountable on a closure, and a pawl that is (1) rotatable relative to the body about a center axis of the body between latched and unlatched positions, and (2) translatable along the center axis of the body for movement between latched and latched-clamped positions to clamp the pawl into engagement with a latch plate or other suitably configured portion of an associated door frame. In preferred practice, the present invention provides a half turn clamping type cabinet latch having a minimum of operating component with the exception that a "primary operating element" is advantageously formed by three inexpensive parts, two of which are identical one with another. The operating components of the latch are easy to assemble and disassemble for service. Moreover, the latch provides a capability for clamping a closure toward a surrounding door frame so that a gasket that is interposed between the closure and the door frame can be compressed as the latch is operated to secure the closure.

2. Prior Art

Clamping type latches of a variety of configurations have been proposed for releasably clamping industrial cabinet closures, access panels, and the like in closed positions relative to surrounding door frames, cabinet structures and the like. Such latches are particularly useful where it is desired (1) to compress a closure sealing gasket that is interposed between peripheral portions of a closure and an associated door frame, (2) to suppress vibration of a closure by clamping it snugly into engagement with a framework that surrounds and defines the opening that is closed by the closure, and/or (3) to provide a tightly closing latch that will compensate for irregularities in manufacturing tolerances or for changes in dimensions due to wear. Examples of several forms of clamping type latches are found in U.S. Pat. No. 4,492,394.

Tool engageable operating heads of a variety of configurations have been proposed for use with latches that have rotatable operating elements. An operating head that is configured to receive an operating tool in the form of an Allen wrench is shown in U.S. Pat. No. 4,413,849. Operating heads that are configured for use with special tools to rotate operating elements of clamping type latches like are disclosed in U.S. Pat. No. 4,369,678 and in U.S. Pat. Nos. Des. 270,229, 270,424, and 270,707.

Some prior proposals utilize pawls that are (1) rotatable relative to a closure mounted body between latched and unlatched orientations, and (2) translatable axially along their rotation axes to effect clamping.

3. The Referenced Parent Case

The invention of the referenced Parent Case addresses a need that, despite prior proposals, long has remained, namely the need for a highly reliable yet simply configured clamping type latch that is mountable on a closure and that has an operating member which, when rotated through a range of about one hundred eighty degrees (a "half turn"), is operable to effect, in sequence, (1) rotation of a pawl about a rotation axis tnrough a range of about a ninety degrees (a "quarter turn") from an unlatched to a latched orientation, followed by (2) translation of the pawl along the rotation axis through a range of travel of about one-fourth of an inch to provide a clamping action that is capable of compressing a door gasket which extends perimetrically about the closure. Furthermore, the invention of the referenced Parent Case addressed other needs that have not been fully addressed by prior proposals including the need ror a latch as described above that has its operating components (i.e., elements that interact to control the movements of the pawl) protectively housed by a latch body, with the operating components being easily removed from the body of the latch for lubrication, service and replacement.

SUMMARY OF THE INVENTION

The present invention represents the work product of a continuing design effort that produced the invention of the referenced Parent Case.

The present invention achieves objectives that were addressed by the invention of the Parent Case, but utilizes a primary operating element that is advantageously formed as an assembly of three parts. The three parts are easier and less expensive to form than is a one-piece operating element of the type that is employed in practicing the invention of the Parent Case.

The three piece construction of the primary operating element has several advantages. It minimizes the cost that is associated in providing a family of latches that are operable by a variety of tools, because only one of the three pieces needs to be exchanged to ready a latch to operate in response to use of an alternate form of tool. Additionally, the three pieces (two of which are semi-circular sleeve halves that can be formed by stamping, and the other of which is a simply configured generally cylindrical core that is easily formed by die casting) can be formed with less tooling expense than can an equivalent one-piece member. Still further, the three piece construction permits a limited degree of relative movement among the three pieces during operation of the latch, with the "free floating" pieces serving to smooth latch operation and minimize "binding." The present invention provides these features without loss of advantages and features that obtain with latches that embody the invention of the referenced Parent Case.

Thus, the present invention provides a novel and improved, simple and inexpensive, closure mountable, half turn, clamping type cabinet latch having operating components that are protectively nested within a body passage, including a three-part primary operating element that is rotatable through about a half turn to carry out, in sequence, a quarter turn rotation of a pawl about a rotation axis from an unlatched position to a latched position, followed by a translation of the pawl along the rotation axis from the latched position to a clamped-latched position. Moreover, with the deliberate exception of forming the primary operating element as a three part structure, the present invention utilizes a minimal number of simply configured operating components, and retains the operating components within the body passage by using a conventional retainer such as a snap ring that can be removed with ease to enable the operating components to be lubricated, serviced and replaced as may be needed.

More specifically, a cabinet latch embodying the preferred practice of the present invention includes a body that is mountable on a closure panel or the like. A passage is formed through the body along a center axis, and opens through forward and rearward end regions of the body. An assembly of operating components is protectively nested within the body passage, including a three part primary operating element that is journaled for rotation within the forward end region of the body passage, and an elongate shank that has a portion which projects from the rearward end region of the body passage and carries a pawl. The shank and the pawl are rotatable about and movable axially along the center axis to position the pawl among unlatched, latched and latched-clamped positions for selectively releasing, retaining, and securely clamping the closure in a closed position relative to an associated cabinet or the like. Movement of the pawl is effected in response to rotation of the primary operating element, and is controlled by the assembly of operating components that is carried within the body passage. A half turn rotation of the primary operating element in one direction of rotation causes the pawl to move in sequence (1) by rotating a quarter turn about the center axis from an unlatched position to a latched position, and (2) by translating axially along the center axis from the latched position to a latched-clamped position. A half turn rotation of the primary operating element in the opposite direction reverses the pawl's movements. A snap ring installed in the rearward end regron of the body passage retains the operating components in place in the body passage, and is readily removable to permit component removal for lubrication and service.

The assembly of operating components that is housed within the body passage includes two concentrically nested sleeves that surround a forward end region of the elongate shank that extends rearwardly from the body for mounting the pawl. The outer of these two sleeves is formed by the two identical semi-circular sleeve halves of the "primary operating element" that drivingly engage a generally cylindrical core of the "primary operating element." The two semi-circular sleeve halves and the core are journaled as an assembly within the forward end region of the body passage. The inner sleeve is a one-piece structure that has a pair of opposed radially extending projections which are received in grooves that are formed in the body to prevent the inner sleeve from rotating relative to the body. A radially extending pin passes through a hole formed in the shank, through L-shaped slots formed in opposed wall portions of the inner sleeve, and has end regions that project into curved cam slots that are formed in each of the semi-circular sleeve halves of the three part "primary operating element." An operating formation is preferably provided on the core portion of the "primary operating element" for receiving a tool to rotate the two sleeve halves relative to the body. When the two sleeve halves are rotated, the inner sleeve and the pin cooperate to effect, in sequence, rotation of the shank about the center axis and translation of the shank axially along the center axis to cause the pawl to move among its unlatched, latched and latched-clamped positions.

A feature of a latch that incorporates the preferred practice of the invention resides in the use of a body passage that has a reduced diameter forward end region that cooperates with a snap ring that is installed within a groove formed in a rearward end region of the body passage to secureiy but releasably retain the assembly of interactive operating components within the body passage. Stated in another way, the body passage is advantageously configured in such a way that the entire array of interactive operating components including the three parts of the primary operating element are protectively housed therein, are maintained in operational interengagement, and are removably accessed by virtue of a single easy-to-install-and-remove snap ring.

Another feature that obtains with the preferred practice of the present invention arises by virtue of the type of driving connection that is provided between the sleeve halves and the core that cooperate to define the primary operating element. In preferred practice, driving connections are established by providing interleaved drive formations that extend generally axially along the center axis of the latch, with the drive formations of the sleeve halves interfitting with the drive formations of the core to drivingly transmit torque forces among the parts of the primary operating element while still permitting a small degree of relative axial movement among these elements. By this arrangement, the axial positioning of the core within the body (and hence the action of a compression coil spring that operates on the core) does nothing to inhibit what may be thought of as the free-floating positioning of the sleeve halves within the body, whereby the axial positioning of the sleeve halves within the body tends to take place primarily under the influence of such operating forces as are imposed on the sleeve halves during latch operation. Stated in another way, the sleeve halves tend to "float" axially within the body (within a limited range of movement) and aid in distributing operating forces to avoid force concentrations and to thereby assure that the latch operates smoothly without "binding."

A further feature of a latch embodying the preferred practice of the present invention lies in the simplicrty of its construction, and in the rugged, dependable character of its components. The body, the inner sleeve, and the core part of the primary operating element may be formed as die cast members. The shank and the pin are relatively simply configured parts that can be formed inexpensively with minimal machining. The pawl and the two identical semi-circular sleeve halves of the primary operating element may be formed as inexpensive stampings. Other components are either standard, commercially available parts, or are easily formed.

BRIEF DESCRIPTION OF THE DRAWINGS

The foregoing and other features and a fuller understanding of the invention may be had by referring to the following description and claims, taken in conjunction with the accompanying drawings, wherein:

DESCRIPTION OF THE PREFERRED EMBODIMENT

Figure 2:
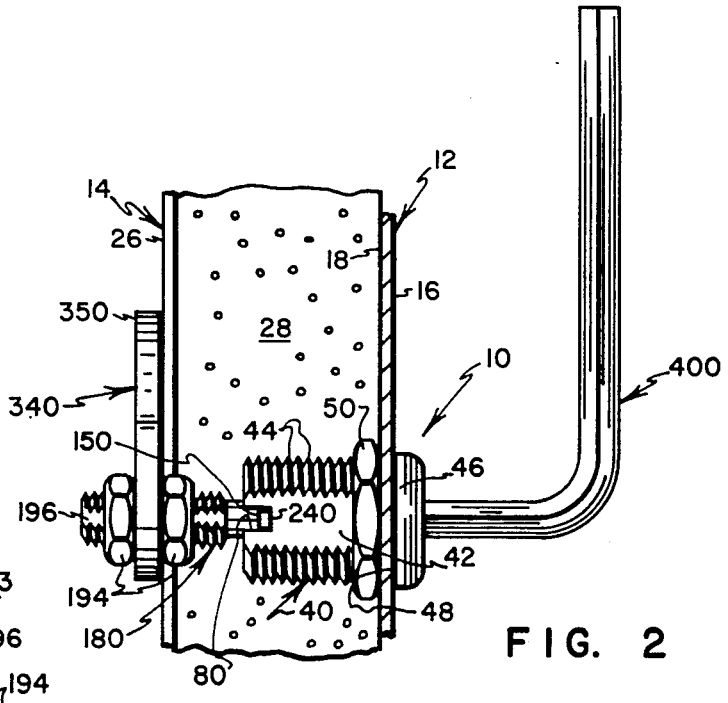
FIG. 2 is a side elevational view thereof, but with a portion of the closure being shown in cross section as seen from a plane indicated by a line 2—2 in FIG. 1.

Referring to FIGS. 1–9, a latch that embodies the preferred practice of the present invention is indicated generally by the numeral 10. The latch 10 is shown mounted on a movable closure plate 12, and has a pawl 340 that cooperates with an associated door frame structure 14 to releasably retain and securely clamp the closure plate 12 closed. The closure plate 12 has a front face 16, a rear face 18, and a rearwardly turned flange 20. The door frame structure 14 has a front plate portion 22, a rearwardly extending portion 24, and a rear plate portion 26. A resilient door gasket 28 is interposed between the rear face 18 of the closure plate 12 and the rear plate portion 26 of the door frame structure 14.

Figure 3:
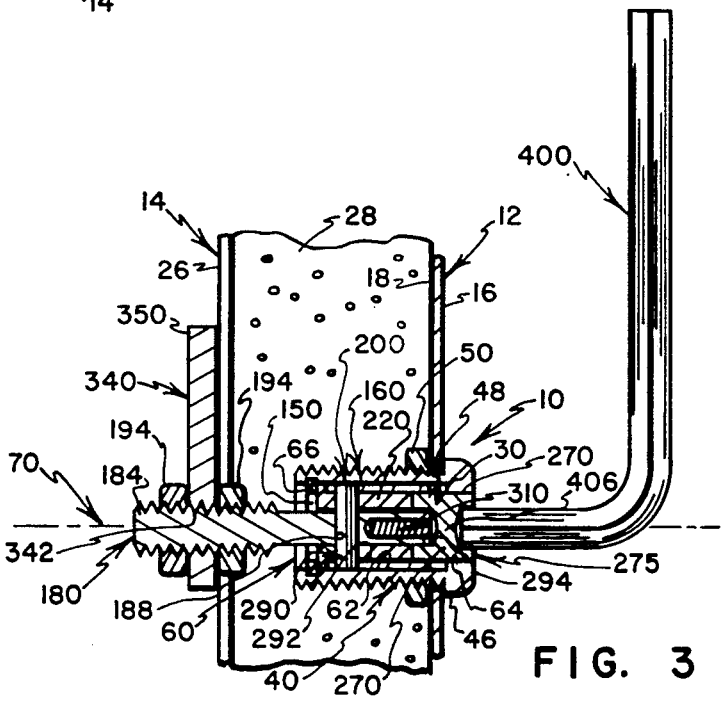
FIG. 3 is a sectional view thereof as seen from a plane indicated by a line 3—3 in FIG. 1.
Figure 10:
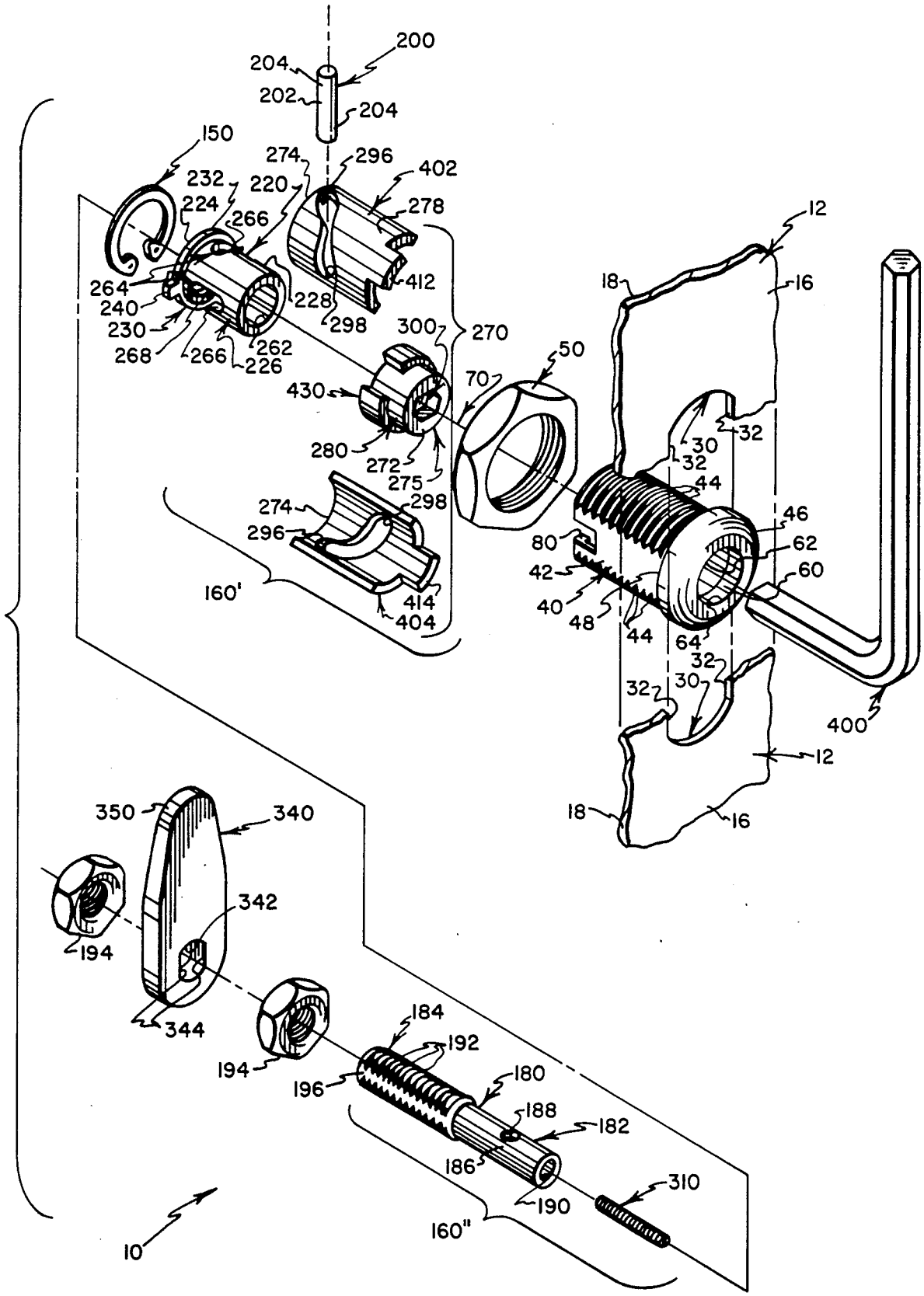
FIG. 10 is an exploded perspective view of the components of the latch, including portions of a closure that mounts the latch, and an Allen wrench for operating the latch.
Figure 11:
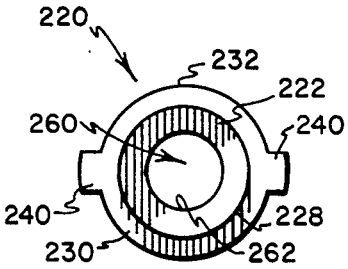
FIG. 11 is a front end view of an inner "plug" or "sleeve" that is utilized in the latch.
Figure 12:
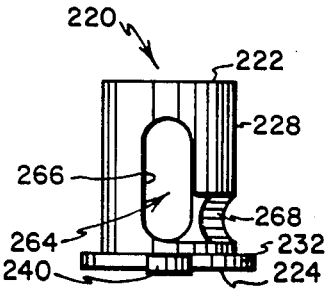
FIG. 12 is a side elevational view thereof as seen from either the right or left side of FIG. 11.
Figure 13:
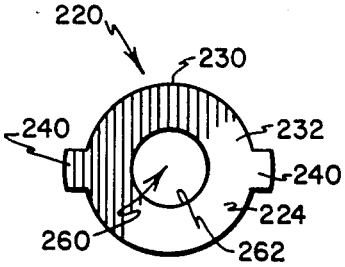
FIG. 13 is a rear end view thereof.
Figure 14:
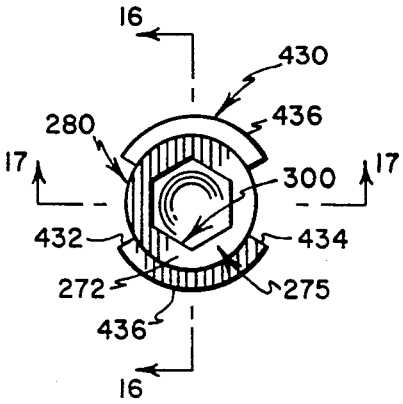
FIG. 14 is a front end view of a core that is three elements of an outer "plug" or "sleeve" which is utilized as a "primary operating element" in the latch.
Figure 15:
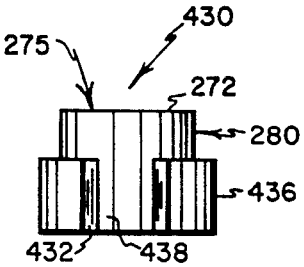
FIG. 15 is a side elevational view thereof as seen from either the right or left side of FIG. 14.
Figure 16:
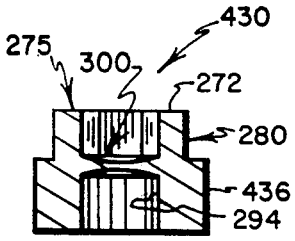
FIGS. 16 and 17 are sectional views as seen from planes indicated by lines 16—16 and 17—17 in FIG. 14.
Figure 17:
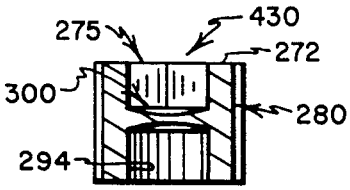
Figure 18:
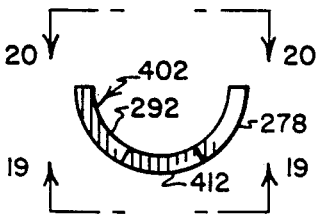
FIG. 18 is a front end view of one of a pair of identical semi-circular sleeve halves that, together with the core shown in FIGS. 14–17, comprise the three parts of the "primary operating element" of the latch.
Figure 19:
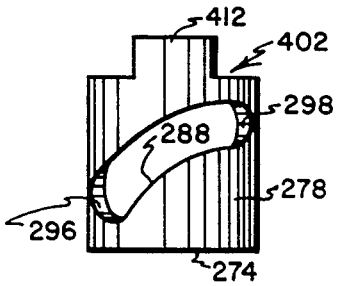
FIGS. 19 and 20 are side elevational views thereof as seen from planes indicated by lines 19—19 and 20—20 in FIG. 18.
Figure 20:
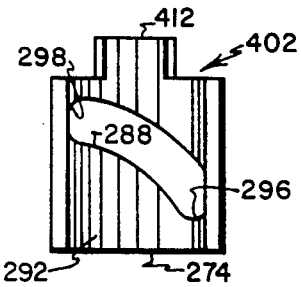

Rererring to FIGS. 3 and 10, a mounting hole 30 is formed through the closure plate 12. A pair ot flat surface portions 32 define opposite sides of the hole 30. The latch 10 has a generally cylindrical shaped body 40 with a pair of flat surfaces 42 (best seen in FIG. 1) extending along opposite sides of the body 40. The body 40 extends through the hole 30 with the flat surfaces 42 of the body 40 engaging the flat surface portions 32 of the hole 30 to prevent the body 40 from turning in the hole 30. Threads 44 extend along much of the outer surface of the body 40. A head formation 46 is provided at the forward end region of the body 40, with a shoulder 48 forming a transition between the threaded region 44 and the head formation 46. The shoulder 48 engages the front face 16 of the closure plate 12. A nut 50 is threaded onto the threaded region 44 of the body 40 and is tightened into engagement with the rear face 18 of the closure plate 12 to hold the latch 10 in place on the closure plate 12.

Referring to FIGS. 3 and 10, the body 40 has a passage 60 formed therethrough. The body passage 60 is coaxial about an imaginary line 70 that will be referred to as a "center axis." The passage 60 provides an inner surface 62 that is of substantially uniform inner diameter along its length except that, in the vicinity of the front end region the passage 60 defines a reduced diameter front end portion 64, and, in the vicinity of the rear end region the inner diameter 62 of the passage 60, is interrupted by a circumferentially extending groove 66 (best seen in FIG. 3) that extends substantially concentrically about the center axis 70 and faces radially inwardly. The groove 66 is configured for receiving and releasably retaining peripheral portions of a radially compressed retainer such as a snap ring 150.

A pair of notches 80 (best seen in FIGS. 4, 6 and 8) are formed in diametrically opposed sides of the rear end region of the body 40. Each of the notches 80 opens into the passage 60, and each extends axially along the body 40 from the rearward end thereof to positions wherein the notches 80 intersect with the circumferentially extending groove 66.

The radially compressible snap ring 150 is a commercially available item of generally C-shaped configuration, formed from resilient material. The snap ring 150 has peripheral portions that may be radially compressed to enable the snap ring 150 to be inserted into the rear end region of the body passage 60. Peripheral portions of the snap ring 150 are operable to seat in the circumferentially extending groove 66 to retain the snap ring 150 in place within the body passage 60.

Referring to FIGS. 3–9, an assembly of operating components 160 (in FIG. 10 the operating components that form this assembly are designated by brackets 160', 160'') is carried by the body 40, with the assembly 160 being insertable into the body passage 60 through the rear end region of the passage 60. The assembly 160 is retained within the passage 60 by positioning the snap ring 150 so that its peripheral portions are seated in the circumferentially extending groove 66. When the snap ring 150 has been installed so that it functions to retain the assembly 160 within the body passage 60, the snap ring 150 nonetheless remains accessible through the rear end region of the passage 60, whereby peripheral portions of the snap ring 150 may be radially compressed to enable the snap ring 150 and the assembly 160 to be removed from the body 40 through the rear end region of the passage 60 for lubrication, service and repair. The assembly 160 includes a shank 180, a pin 200, an inner plug 220, a three part outer plug assembly 270, and a spring 310. These elements comprise what are referred to as "operating components" that are inserted into the body passage 60 as an assembly 160 that is releasably held in place in the body 40 by the snap ring 150.

Referring to FIG. 10, the shank 180 has an elongate, generally cylindrical forward end region 182, a rearward end region 184, and an outer surface 186 that interconnects the forward and rearward end regions 182, 184. The shank 180 is oriented to extend substantially concentrically along the central axis 70 with its forward end region 182 positioned within the body passage 60, with its outer surface 186 extending from within the confines of the passage 60 and rearwardly out of the passage 60, and with its rearward end region 184 located rearwardly with respect to the body 40. The shank 180 has a generally radially extending hole 188 formed through its forward end region 182, with opposed ends of the hole 188 opening through the outer surface 186 of the shank 180 at locations within the confines of the body passage 60. A hole 190 is formed in the forward end region 180 and extends a short distance along the center axis 70 to receive one end region of the spring 310. The rearward end region 184 of the shank 180 has threads 192 formed on its outer surface 186. A pair of lock nuts 194 are threaded onto the threads 192 to clamp the pawl 340 therebetween. A pair of opposed flats 196 interrupt the threads 192.

The pin 200 is of elongate, generally cylindrical configuration, and has a central portion 202 that is received by the hole 188 formed in the shank 180. The pin 200 has opposed end regions 204 that project radially outwardly from the shank hole 188 and extend into close proximity with radially opposed portions of the inner surface 62 of the body passage 60.

Referring to FIGS. 10–13, the inner plug 220 is provided as a one-piece member that extends along the center axis 70 and has forward and rearward ends 222, 224. The inner plug 220 has a generally cylindrical sleeve portion 226 of a substantially uniform outer diameter 228 that extends concentrically about and axially along the center axis 70 from the forward end 222 of the inner plug 220 toward the rearward end 224 thereof. A relatively thin washer-like portion 230 defines the rearward end 224 of the inner plug 220. The washer-like portion 230 is formed integrally with the sleeve portion 226 and extends radially outwardly relative to the sleeve portion 226. The washer-like portion 230 has peripheral portions 232 that are configured to permit their being inserted with a slip fit into the body passage 60 through the rearward end region of the body passage 60, and has a pair of opposed projections 240 configured to be received by the notches 80 that are formed in the body.

A hole 260 is formed through the sleeve portion 226 of the inner plug 220 and through the washer-like portion 230. The hole 260 has a substantially uniform inner diameter 262 that extends along the center axis 70, with the inner diameter 262 of the hole 260 being operable to journal the outer surface 186 of the forward end region 182 of the shank 180 for smooth rotation relative to the inner plug 220.

A pair of generally L-shaped slots 264 are formed in the sleeve portion 226 of the inner plug 220. The slots 264 open through the inner diameter 262 and the outer diameter 228 of the sleeve portion 226. Each of the slots 264 has first and second leg portions 266, 268 that extend substantially orthogonally relative to each other, with the first leg portrons 266 extending substantially axially with respect to the center axis 70, and with the second leg portions 268 extending substantially circumferentially about the sleeve portion 226. Opposed end regions 204 of the pin 200 extend through the generally L-shaped slots 264.

Figure 21:
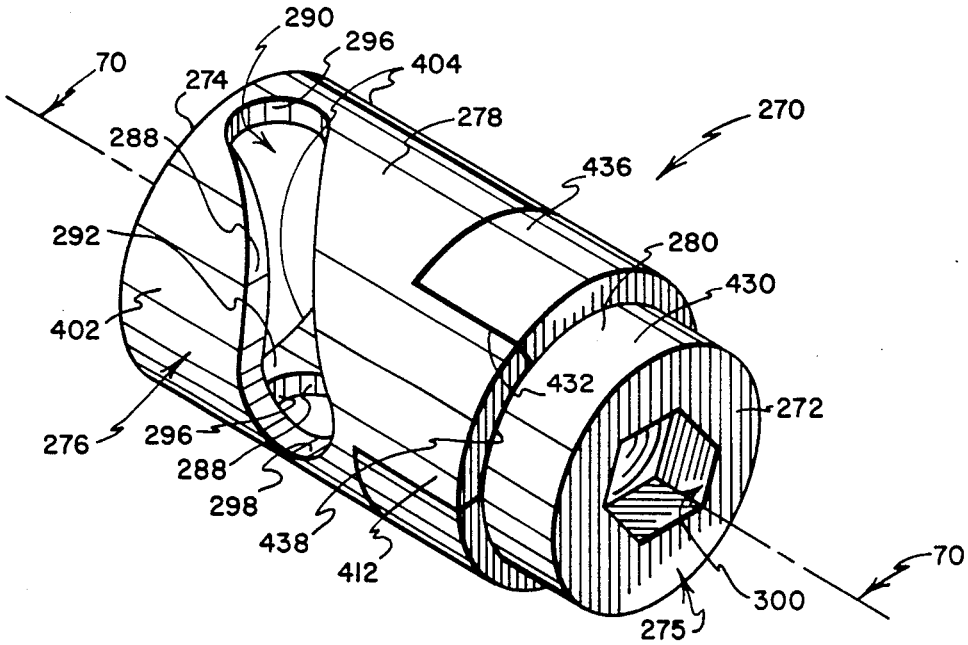
FIG. 21 is a perspective view, on an enlarged scale, of the three parts of the "primary operating element" in their assembled configuration; and, FIG. 22 is a front end view of the assembled parts of the "primary operating element."
Figure 22:
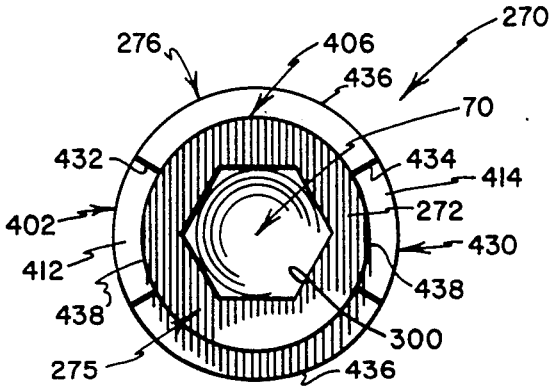

Referring to FIGS. 10 and 14–20, and particularly to FIGS. 21 and 22, the outer plug structure 270 is a three-piece assembly that extends along the center axis 70 and, when assembled, defines forward and rearward end surfaces 272, 274. When the parts of the outer plug structure 270 are assembled as shown in FIGS. 21 and 22, the plug structure 270 provides a generally cylindrical sleeve portion 276 that is defined principally by a pair of semicircular sleeve halves 402, 404 that extend perimetrically about a cylindrical core 430. The sleeve portion 276 that results when the halves 402, 404 are assembled with the core 430 has a substantially uniform outer diameter 278 and extends concentrically about and axially along the center axis 70 from a rearward end 274 of the outer plug structure 270 toward a forward end 272 thereof. The uniform outer diameter 278 of the outer plug structure 270 is of a size that enables it to be journaled for smooth rotation about the center axis 70 by the inner diameter 62 of the body passage 60. The outer plug structure 270 also has a relatively reduced diameter portion 280 that is defined by the core 430, with the reduced diameter portion 280 extending rearwardly along the center axis 70 from the forward end 272. When the latch 10 is fully assembled, the reduced diameter portion 280 extends along the center axis 70 and is received within the reduced diameter forward end region 64 of the body passage 60, and exposes a front operating element face 275. A tool-receiving formation 300 is provided that opens through the face 275.

Referring to FIGS. 14–17, the core 430 defines a pair of grooves 432, 434 on opposed sides thereof. The grooves 432, 434 are formed in a relatively large diameter outer surtace 436 that is of substantially the same diameter as the outer diameter 278 of the assembled outer plug structure 270, and has groove bottom walls 438 that are defined by extensions of the reduced diameter 280. Referring to FIG. 10, the sleeve halves 402, 404 have forwardly projecting portions 412, 414 that extend into the grooves 432, 434, respectively, to establish driving connections among the parts of the outer plug structure 270. As is best seen in FIGS. 21 and 22, when the elements 402, 404 and 430 are assembled to form the primary operating element 270, the driving formations 412, 414 that are seated in the grooves 432, 434 of the core surface 436 provide an interleaved array of formations that are arranged in an imaginary circle that is concentric about the center axis 70.

When the elements 402, 404 and 430 of the outer plug structure 270 are assembled as shown in FIGS. 21 and 22, the sleeve halves 402, 404 and the core 430 cooperate to define a hole 290 (see also FIG. 3) that extends interiorly of the the sleeve portion 272 and into the rearward end 274 of the core 430. The hole 290 has a first substantially uniform inner diameter 292 that extends along the center axis 70 through much of the sleeve portion 276 (i.e., between the sleeve halves 402, 404), and has a second reduced diameter portion 294 that extends a short distance further along the axis 70 (i.e., into the core 430). The inner diameter 292 of the hole 290 is operable to journal the outer diameter of the inner plug 220 for rotation therein relative to the outer plug 270. The inner diameter 294 serves to receive one end region of the spring 310, as is best seen in FIG. 3.

Referring to FIGS. 10, and 19–22, a pair of curved cam slots 288 are formed in the sleeve portion 276 (i.e., in the sleeve halves 402, 404) and open through the inner diameter 292 and the outer diameter 278 ot the sleeve portion 276. The curved cam slots 288 receive opposed end regions 204 of the pin 200. The cam slots 288 have end regions 296, 298 that (1) are spaced axially along the center axis 70 to define a path of travel for the pin 200 that extends about one fourth of an inch along the axis 70, and (2) are radially spaced about the axis 70 to define a path of travel for the pin 200 that extends for about a quarter of a revolution about the axis 70.

An operator engageable formation 300 is provided on the operating element face 275 (i.e., on the front face of the core 430) for enabling an operator (i.e., a tool) to effect relative movement of the outer plug structure 270 relative to the body 40 to operate the latch 10. In preferred practice the formation 300 is a hex opening that is sized to receive a conventional hex Allen wrench 400. Alternatively, specially configured operator head formations (not shown herein) such as are depicted in the drawings of U.S. Pat. Nos. Des. 207,707 and 270,229, and U.S. Pat. No. 4,369,678 may be employed. Tools used to rotate such specially configured operator heads are disclosed in referenced U.S. Pat. No. Des. 270,424 and U.S. Pat. No. 4,369,678.

The spring 310 is a compression coil spring 310 that extends along the center axis 70 and is interposed between the shank 180 and the core 430 of the outer plug structure 270 to bias the shank 180 relatively rearwardly with respect to the body 40, and to bias the core 430 of the outer plug structure 270 relatively forwardly with respect to the body 40. One end of the spring 310 extends into the shank hole 190, and the other into small diameter hole 294 of the core 430. While the presence of the spring 310 is not required for proper operation of the latch 10, the spring 310 serves the useful function of maintaining the majority of the operating components of the assembly 160 in engagement one with another and/or in engagement with the body 40 to prevent vibration and other unintended relative movement. However, the sleeve halves 402, 404 remain free to translate axially within the confines of the body passage 60, for the axial forces that are applied by the spring 310 are not directly imposed on the sleeve halves 402, 404. The limited degree of freedom movement enjoyed by the sleeve halves 402, 404 often functions to minimize force concentrations that might tend to result in "binding" of the components of the latch 10 during operation.

The pawl 340 is connected to the shank 180. The pawl 340 is an elongate metal stamping that has a hole 342 formed near one end to receive the rearward end region 184 of the shank 180. The hole 342 has a pair of flat surfaces 344 formed on opposed sides thereof for drivingly engaging the flats 196 formed on the shank 180. The lock nuts 194 are clamped into engagement with opposed sides of the pawl 340 to hold the pawl 340 in place on the shank 180. The pawl 340 is mounted on the shank 180 such that the pawl 340 extends radially with respect to the center axis 70, and has a distal end region 350 that is movable into and out of engagement with the door frame 14 to selectively release, retain, and clamp the closure 12 closed.

In operation, the latch 10 utilizes clockwise and counterclockwise rotary movements of the operating element 275 to effect rotary and axial movements of the pawl 340 about the center axis 70 among the unlatched, latched and latched-clamped positions, and to thereby release, retain and securely clamp the closure 12 in a closed position relative to the associated door frame 14.

Figure 1:
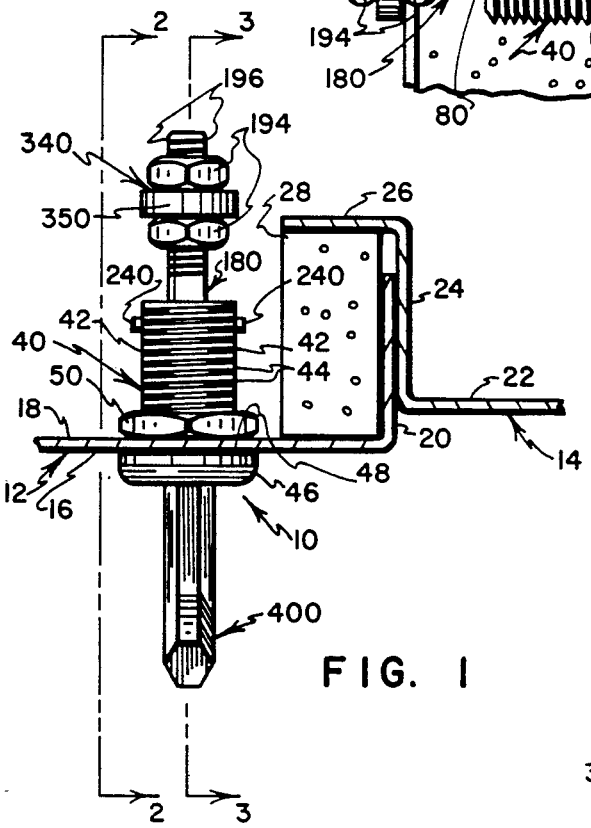
FIG. 1 is a top plan view of a latch embodying the preferred practice of the present invention, with the latch installed on a closure, with the closure being shown adjacent a frame structure but in a position where a resilient gasket that is interposed between the closure and the frame structure has not been compressed, with the closure and the frame structure being shown in cross section, with components of the latch being oriented in their unlatched positions, and with the view also depicting an Allen wrench that may be used to operate the latch.

The "unlatched" position ot the pawl 340 is depicted in FIGS. 1–5. Referring to FIGS. 1 and 2, it will be seen that, when the pawl 340 is "unlatched," it extends substantially parallel to the juncture of the closure 12 and the frame 14, whereby the pawl 340 does nothing to obstruct, block or otherwise prevent relative movement of the closure 12 and the door frame 14.

Figure 5:
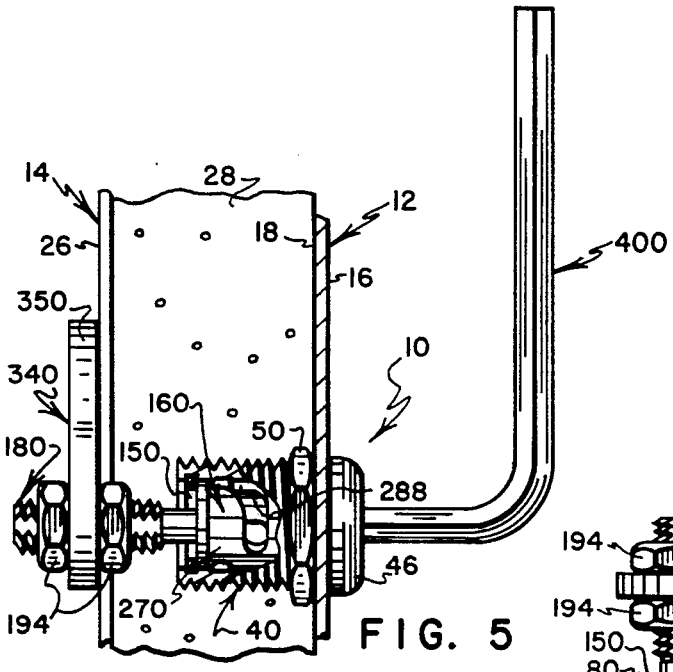
FIGS. 4 and 5 are top plan and side elevational views thereof similar to FIGS. 1 and 2, respectively, and with components of the latch being oriented in their unlatched positions, but with portions of the latch being broken away.
Figure 4:
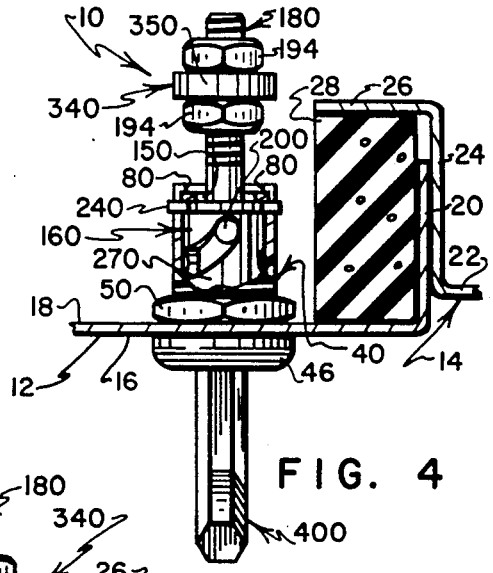
Figure 7:
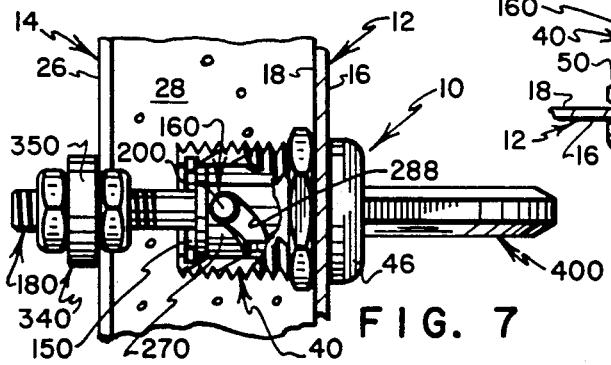
FIGS. 6 and 7 are top plan and side elevational views similar to FIGS. 4 and 5, respectively, but with components of the latch oriented in their latched positions.
Figure 6:
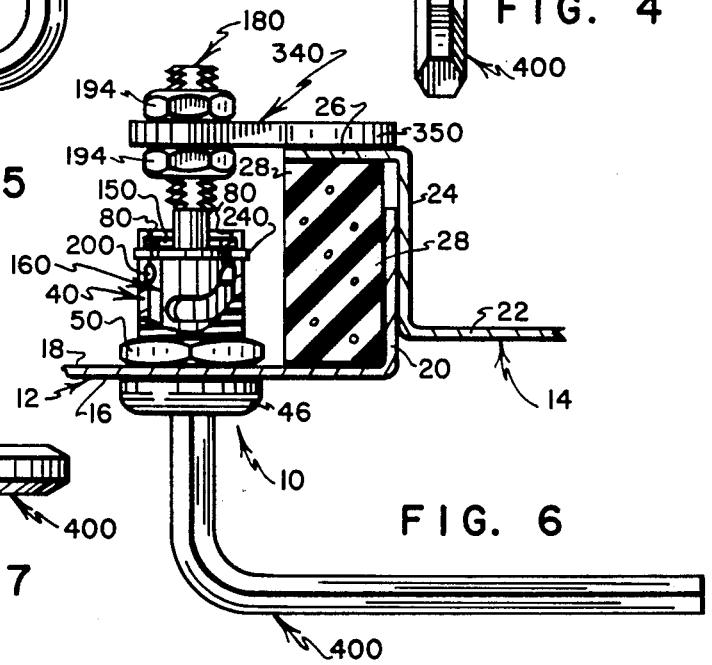

The "latched" position of the pawl 340 is depicted in FIGS. 6 and 7. By comparing FIGS. 6 and 7 with FIGS. 4 and 5, it will be seen that, when the pawl 340 moves from its "unlatched" to its "latched" position, such movement entails nothing more than a simple quarter turn rotation of the shank 180 and the pawl 340 about the center axis 70 in response to a quarter turn rotation of the operating element 275 by the Allen wrench 400. When "latched," the pawl 340 extends transversely with respect to the juncture of the closure 12 and the frame 14 so that the distal end region 350 of the pawl 340 overlies the rear plate portion 26 of the door frame 14. When the pawl 340 is "latched," the pawl 340 obstructs and thereby prevents movement of the closure 12 toward its open position. However, as is readily seen by comparing the identical conditions of the door gasket 28 as shown in FIGS. 4 and 6, rotational movement of the pawl 340 from its unlatched to its latched position does nothing to effect compression of the door gasket.

Figure 9:
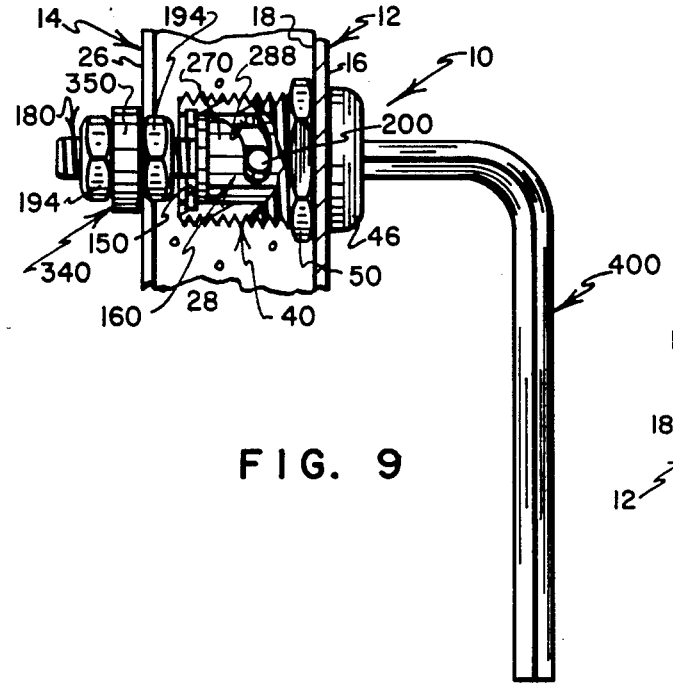
FIGS. 8 and 9 are top plan and side elevational views similar to FIGS. 6 and 7, respectively, but with components of the latch being oriented in their latched-clamped positions, and with the resilient gasket being compressed by the closure and the frame structure which have moved toward each other under the clamping influence of the latch.
Figure 8:
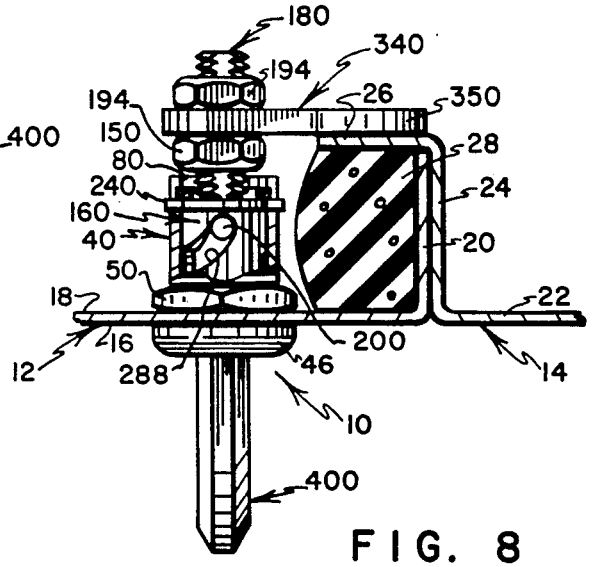

The "latched-clamped" position of the pawl 340 is depicted in FIGS. 8 and 9. By comparing to FIGS. 8 and 9 with FIGS. 6 and 7, it will be seen that, when the pawl 340 moves from its "latched" to its "latched-clamped" position, such movement entails nothing more than a simple axial translation of the shank 180 and the pawl 340 along the center axis 70 in response to a further quarter turn rotation of the operating element 275 by the Allen wrench 400. When in its "latched-clamped" position, the pawl 340 extends transversely with respect to the juncture of the closure 12 and the frame 14 so that the distal end region 350 of the pawl 340 not only overlies the rear plate portion 26 of the door frame 14 but also clamps the rear plate portion 26 to a degree that the closure 12 is forced to compress the door gasket 28 against the rear plate portion 26, as is best seen in FIG. 8.

A half turn counterclockwise rotation of the operating element 275 reverses the aforedescribed series of pawl movements, causing the pawl 340 to move from its latched-clamped to its latched, and thence to its unlatched positions.

The relative movements of the various operating components that cause the pawl 340 to behave as described in response to half turn rotations of the operating element 275 are most easily understood by beginning with an understanding of exactly which parts move, and how they move. To begin with, the body 40 and the inner plug 220 do not rotate relative to each other; rather, they are "keyed" together by the projections 240 of the inner plug 220 extending into the notches 80 that are formed in the body 40. Because the inner plug 220 does not rotate relative to the body 40, the legs 266, 268 of the L-shaped slots 264 that are defined in opposed walls of the inner plug 220 define the only two types of movement that can be executed by the shank 180 and the pawl 340, namely radial and axial movements. The circumferentially extending leg portions 268 of the L-shaped slots 264 define tracks that permit the pin 200 that extends through the shank 180 to rotate, i.e., to rotate in a plane that extends perpendicularly relative to the center axis 70. The axially extending leg portions 266 of the L-shaped slots 264 define tracks that permit the pin 200 to move axially along the center axis 70 with the shank 180.

The outer plug structure 270 (i.e., the sleeve halves 402, 404 and the core 430) is free to rotate within the body passage 60, but its movements are limited by the degree of freedom that is afforded by the ends 204 of the pin 200 extending through the L-shaped slots 264 of the inner plug 220, and through the curved cam slots 288 of the outer plug structure 270.

Referring to FIGS. 4 and 5, the pin 200 is seen to extend parallel the juncture of the closure 12 and the frame 14 when the latch 10 is unlatched. Referring to FIGS. 6 and 7, the pin 200 is seen to extend transversely relative to the juncture of the closure 12 and the frame 14 when the latch 10 is latched. Thus, in moving between latched and unlatched positions, the pin 200 is rotated together with the shank 180 and the pawl 340, with the ends 204 of the pin 200 following the tracks provided by circumferentially extending leg portions 268 of the L-shaped slots 264. The shank 180 does not move axially during such rotation because the circumferentially extending leg portions 268 of the L-shaped slots 264 maintain movement of the pin 200 within a plane that is defined by the circumferentially extending leg portions 268, i.e., the ends 204 of the pin 200 remain in the ends 296 of the curved cam slots 288.

Referring to FIGS. 8 and 9, the pin 200 is seen to maintain its transverse orientation (transverse with respect to the juncture of the closure 12 and the frame 14) in moving axially with the shank 180 and the pawl 340 between the latched and latched-clamped positions. Such movement is effected by the axially extending leg portions 266 of the L-shaped slots 264 containing pin movement to axial directions, and by the curved cam slots 288 causing the pin ends 208 to translate along the axially extending leg portions 266 of the L-shaped slots 264, with the ends 204 of the pins 200 traveling along the curved cam slots 288 from the end regions 296 to the end regions 298.

As will be apparent from the foregoing description, the present invention provides a rugged, easy to assemble, inexpensive to manufacture, closure-mountable cabinet latch 10. Moreover, the operating components of the latch 10 can be removed with ease from the body passage 60 by compressing and removing the snap ring 150.

A further feature of the present invention lies in the formation of the outer plug structure 270 as a three-part assembly, with the core 430 preferably being formed as a die cast part, and with the sleeve halves 402, 404 being formed as identical stampings. By this arrangement, relatively inexpensive tooling can be used to form the components of the outer plug structure 270, and core elements 430 that carry a variety of differently configured tool-engageable formations 300 can be stocked and used interchangeably to provide latches that operate in response to a variety of specially configured tools.

While the latch 10 has been described and illustrated as being mounted on a closure panel 12, it will be understood that latches embodying the spirit of the present invention can be employed in a wide variety of applications wherein cabinet doors, access panels, electrical boards and the like are to be retained in desired orientations relative to other components. Accordingly, where the terms "closure," "door panel," and the like are used herein, it will be understood that these terms are intended to refer to a wide range of similar components and shall not be construed as being limiting in scope.

Although the invention has been described in its preferred form with a certain degree of particularity, it will be understood that the present disclosure of the preferred form has been made only by way of example, and that numerous changes in the details of construction and the combination and arrangements of parts and the like may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A clamping type cabinet latch, comprising:

(a) body means having a generally cylindrical body for mounting the latch on a closure or the like, the body having a passage extending therethrough along an imaginary center axis;

(b) pawl means that is rotatable and translatable relative to the body along the center axis for movement among unlatched, latched, and latched-clamped positions for selectively releasing, retaining, and securely clamping the closure in a closed position relative to an associated cabinet door frame or the like;

(c) operating element means for rotation relative to the body through a limited range of movement in clockwise and counterclockwise directions about the center axis for operating the latch;

(d) operating component means including an assembly of operating components that are protectively nested within the body for drivingly interconnecting the operating element means with the pawl means for effecting movement of the pawl means relative to the body among said unlatched, latched, and latched-clamped positions in response to clockwise and counter-clockwise rotations of the operating element means about the center axis, with the assembly of operating components being nestable one within another and being insertable as an assembly into the body;

(e) retainer means for cooperating with the body for releasably retaining the assembly of operating components within the body but being removable with ease to provide access to the operating components for lubrication, service and repair;

(f) the assembly of operating components including:

(i) an elongate, generally cylindrical shank having a forward end region, a rearward end region, and an outer surface that interconnects the forward and rearward end regions, the shank being oriented to extend substantially concentrically along the central axis with its forward end region positioned within the body passage, with its outer surface extending from within the confines of the body passage and rearwardly out of the body passage, and with its rearward end region located rearwardly with respect to the body, the shank having a generally radially extending hole formed therethrough with opposed ends of the hole opening through the outer surface of the shank at a location within the confines of the passage;

(ii) a pin having a central portion that is received by the hole formed in the shank, and having opposed end regions that project radially outwardly from the outer surface of the shank into close proximity with diametrically opposed portions of the inner surface of the body passage;

(iii) inner plug means formed as a one-piece member that extends along the center axis and has forward and rearward ends, the inner plug means having:

(A) a generally cylindrical sleeve portion having a substantially uniform outer diameter that extends concentrically about and axially along the center axis from the forward end of the inner plug means toward the rearward end thereof;

(B) interconnection means for interconnecting the inner plug means and the body to prevent relative rotation therebetween;

(C) a hole formed through the sleeve portion and through the washer-like portion and having a substantially uniform inner diameter that extends along the center axis, with the inner diameter being operable to journal the outer surface of the shank for rotation therein relative to the inner plug means; and, (D) a pair of generally L-shaped slots formed in the sleeve portion and opening through the inner diameter and the outer diameter of the sleeve portion, with each of the slots having first and second leg portions that extend substantially orthogonally relative to each other, with the first leg portions extending substantially axially with respect to the center axis, and with the second leg portions extending substantially circumferentially about the sleeve portion, and with the opposed end regions of the pin extending through the generally L-shaped slots;

(iv) outer plug means formed as a three-piece assembly of interfitting parts that extends along the center axis and has forward and rearward ends, the outer plug means having a pair of semi-circular sleeve halves and a generally cylindrical core, with the sleeve halves being arranged to form a tubular structure with portions thereof surrounding and interfitting with portions of the core to establish driving connections among the sleeve halves and the core, and with the sleeve halves and the core cooperating to define:

(A) a generally cylindrical sleeve portion having a substantially uniform outer diameter that extends concentrically about and axially along the central axis from the rearward end of the outer plug means toward the forward end thereof, the uniform outer diameter of the outer plug means being of a size that enables it to be journaled for smooth rotation about the center axis by the inner diameter of the body;

(B) a relatively reduced diameter portion that defines the forward end of the outer plug means, the reduced diameter portion being formed integrally with the sleeve portion and extending along the center axis into the reduced diameter forward end region of the passage formed in the body;

(C) a hole formed in the sleeve portion and opening through the rearward end of the outer plug means, the hole having a substantially uniform inner diameter that extends along the center axis, the inner diameter being operable to journal the outer diameter of the inner plug means for rotation therein relative to the outer plug means; and, (D) a pair of generally curved cam slots formed in the sleeve portion and opening through the inner diameter and the outer diameter and the sleeve portion, with each of the slots defining cam surfaces that receive end regions of the pin.

2. The latch of claim 1 wherein the operating element means comprises a tool engageable formation defined by the reduced diameter portion of the outer plug means and formed integrally therewith as a part of the one-piece outer plug means.

3. The latch of claim 2 wherein the body passage runs substantially centrally through the generally cylindrical body, the body passage defining an inner surface that is of substantially uniform inner diameter along its length except:

(a) in the vicinity of the front end region wherein the body passage defines a reduced diameter front end portion; and, (b) in the vicinity of the rear end region wherein the inner diameter of the body passage is interrupted by a circumferentially extending groove that extends substantially concentrically about the central axis and faces radially inwardly, the groove being configured for receiving and releasably retaining the retainer means.

4. The latch of claim 1 wherein the retainer means includes radially compressible snap ring means of generally C-shaped configuration formed from resilient material and having peripheral portions that may be radially compressed to enable the snap ring means to be inserted into the rear end region of the body passage that is formed in the barrel shaped body, with the peripheral portions being operable to seat in the circumferentially extending groove to retain the snap ring means in the body.

5. The latch of claim 4 wherein the assembly of operating components that is carried by the body is insertable into the body passage through the rear end region of the passage, and being retainable within the body passage by positioning the snap ring means so that its peripheral portions are seated in the circumferentially extending groove, and with the snap ring means being accessible through the rear end region of the body passage when the assembly is being retained in the body by the snap ring means, whereby the peripheral portions of the snap ring means may be radially compressed to enable the snap ring means and the assembly to be removed from the body through the rear end region of the body passage for lubrication, service and repair.

6. The latch of claim 3 wherein:

the interconnection means includes a pair of notches formed in the rear end region of the body and extending substantially radially with respect to the center axis, with each of the notches having an inner end that opens through the inner surface of the body, and an outer end that opens through the outer surface of the body, with the notches extending axially along the body and intersecting with the circumferentially extending groove; and, (b) the interconnection means includes a relatively thin washer-like portion that defines the rearward end of the inner plug means, the washer-like portion being formed integrally with the sleeve portion and extending radially outwardly relative to the sleeve portion, the washer-like portion having peripheral portions that are configured to permit their being inserted into the passage of the body through the rearward end region of the passage, and having a pair of opposed projections configured to be received by the notches formed in the body.

7. The latch of claim 1 additionally including biasing means interposed between the forward end region of the shank and the core of the outer plug means to bias the shank relatively rearwardly with respect to the body, and to bias the core of the outer plug means relatively forwardly with respect to the body for maintaining selected components of the assembly in engagement with each other and to prevent vibration and other unintended relative movement among the components of the assembly.

8. The latch of claim 7 wherein the three pieces of the assembly that comprise the outer plug structure, namely the pair of semi-circular sleeve halves and the generally cylindrical core, are provided with interfitting formation means for establishing a driving connection that will assure that these three pieces will rotate in unison within the body, but with the driving connection being inoperable to transmit axially oriented forces between any of these three pieces, whereby the action of the biasing means along the central axis that tends to bias the core forwardly with respect to the body will not serve to directly forwardly bias the sleeve halves, whereby the sleeve halves are free to axially position themselves within the body independently of the positioning of the core and independently of the positioning of each other, thereby minimizing tendencies of the various operating components to interfere with each other during operation of the latch.

9. The latch of claim 8 wherein the interfitting formation means that drivingly connects the sleeve halves and the core includes axially extending formations provided on each of the sleeve halves and the core, with the axially extending formations interfitting in an interleaved array about the perimeter of an imaginary circle that extends concentrically about the center axis.

10. A clamping type cabinet latch having body means for mounting the latch on a closure or the like, having pawl means that is movable among (1) an unlatched position wherein the pawl means permits opening and closing movements of the closure relative to an associated door frame or the like, (2) a latched position wherein the pawl means overlies a portion of the door frame to prevent opening movement of the closure, and (3) a latched-clamped position wherein the pawl means clampingly engages the door frame to bias the closure toward its closed position, having operating element means connected to the body means and being rotatable relative to the body means through a predetermined range of rotational movement, and having operating component means drivingly interconnecting the operating element means, the body means and the pawl means for causing the pawl means (1) to rotate relative to the body means about a center axis of rotation from the unlatched position to the latched position in response to rotation of the operating element means in a first direction of rotation through a first portion of said range of rotational movement, and (2) to translate along the center axis of rotation from the latched position to the latched-clamped position in response to rotation of the operating element means in said first direction of rotation through a second portion of said range of rotational movement wherein:

(a) the body means includes a barrel shaped body for mounting the latch on a closure or the like, wherein:
  (i) the body has opposed front and rear end regions that are interconnected by a central portion having an outer surface;
  (ii) a passage is formed through the body and extends along the center axis, the passage defining an inner surface that is of substantially uniform inner diameter along its length except:
    (A) in the vicinity of the front end region wherein the passage defines a reduced diameter front end portion; and,
    (B) in the vicinity of the rear end region wherein the inner diameter of the passage is interrupted by a circumferentially extending groove that extends substantially concentrically about the center axis and faces radially inwardly; and,
  (iii) a pair of notches are formed in the rear end region of the body and extending substantially radially with respect to the center axis, with each of the notches opening through the inner surface and the outer surface of the body, and with the notches extending axially along the body and intersecting with the circumferentially extending groove;

(b) a radially compressible snap ring means of generally C-shaped configuration formed from resilient material and having peripheral portions that may be radially compressed is inserted into the rear end region of the body passage, with the peripheral portions being seated in the circumferentially extending groove to retain the snap ring means in the body; and, (c) the operating component means takes the form of an assembly of operating components that is carried by the body, with the assembly being insertable into the body passage through the rear end region thereof, and being retainable within the body passage by positioning the snap ring means so that its peripheral portions are seated in the circumferentially extending groove, and with the snap ring means being accessible through the rear end region of the body passage when the assembly is being retained in the body by the snap ring means, whereby the peripheral portions of the snap ring means may be radially compressed to enable the snap ring means and the assembly to be removed from the body through the rear end region of the body passage for lubrication, service and repair, the assembly including:
  (i) an elongate, generally cylindrical shank having a forward end region, a rearward end region, and an outer surface that interconnects the forward and rearward end regions, the shank being oriented to extend substantially concentrically along the center axis with its forward end region positioned within the body passage, with its outer surface extending from within the confines of the body passage and rearwardly out of the body passage, and with its rearward end region located rearwardly with respect to the body, the shank having a generally radially extending hole formed therethrough, with opposed ends of the hole opening through the outer surface of the shank at a location within the confines of the body passage;
  (ii) a pin having a central portion that is received by the hole formed in the shank, and having opposed end regions that project radially outwardly from the outer surface of the shank into close proximity with radially opposed portions of the inner surface of the body passage;

(iii) inner plug means formed as a one-piece member that extends along the center axis and has forward and rearward ends, the inner plug means having:

(A) a generally cylindrical sleeve portion having a substantially uniform outer diameter that extends concentrically about and axially along the center axis from the forward end of the inner plug means toward the rearward end thereof;

(B) a relatively thin washer-like portion that defines the rearward end of the inner plug means, the washer-like portion being formed integrally with the sleeve portion and extending radially outwardly relative to the sleeve portion, the washer-like portion having peripheral portions that are configured to permit their being inserted into the body passage through the rearward end region of the body passage, and having a pair of opposed projections configured to be received by the notches formed in the body;

(C) a hole formed through the sleeve portion and through the washer-like portion and having a substantially uniform inner diameter that extends along the center axis, the inner diameter of the hole being operable to journal the outer surface of the shank for rotation therein relative to the inner plug means; and, (D) a pair of generally L-shaped slots formed in the sleeve portion and opening through the inner diameter and the outer diameter of the sleeve portion, with each of the slots having first and second leg portions that extend substantially orthogonally relative to each other, with the first leg portions extending substantially axially with respect to the center axis, and with the second leg portions extending substantially circumferentially about the sleeve portion, and with the opposed end regions of the pin extending through the generally L-shaped slots;

(iv) outer plug means formed as a three-piece assembly of interfitting parts that extends along the center axis and has forward and rearward ends, the three pieces of the outer plug means including a pair of semi-circular sleeve halves and a generally cylindrical core, with the sleeve halves being arranged to form a tubular structure with portions thereof surrounding and interfitting with portions of the core to establish driving connections among the sleeve halves and the core, and with the sleeve halves and the core cooperating to define:

(A) a generally cylindrical sleeve portion having a substantially uniform outer diameter that extends concentrically about and axially along the center axis from the rearward end of the outer plug means toward the forward end thereof, the uniform outer diameter of the outer plug means being of a size that enables it to be journaled for smooth rotation about the center axis by the inner diameter of the body;

(B) a relatively reduced diameter portion that defines the forward end of the outer plug means, the reduced diameter portion being formed integrally with the sleeve portion of the outer plug means and extending along the center axis into the reduced diameter forward end region of the body passage;

(C) a hole formed in the sleeve portion of the outer plug means and opening through the rearward end of the outer plug means, the hole having a substantially uniform inner diameter that extends along the center axis, the inner diameter being operable to journal the outer diameter of the inner plug means for rotation therein relative to the outer plug means;

(D) a pair of generally curved slots formed in the sleeve portion and opening through the inner diameter and the outer diameter of the sleeve portion of the outer plug means, with each of the curved slots defining cam surfaces that receive end regions of the pin and cooperate therewith to define a combined axial and radial type of relative movement that is permitted between the shank and the outer plug means; and, (E) the operating element means being connected to the outer plug means for enabling an operator to effect movement of the outer plug means relative to the body to operate the latch.

11. The latch of claim 10 wherein the body passage runs substantially centrally through the generally cylindrical body, the body passage defining an inner surface that is of substantially uniform inner diameter along its length except:

(a) in the vicinity of the front end region wherein the body passage defines a reduced diameter front end portion; and, (b) in the vicinity of the rear end region wherein the inner diameter of the body passage is interrupted by a circumferentially extending groove that extends substantially concentrically about the central axis and faces radially inwardly, the groove being configured for receiving and releasably retaining the retainer means.

12. The latch of claim 11 wherein the retainer means includes radially compressible snap ring means of generally C-shaped configuration formed from resilient material and having peripheral portions that may be radially compressed to enable the snap ring means to be inserted into the rear end region of the body passage that is formed in the barrel shaped body, with the peripheral portions being operable to seat in the circumferentially extending groove to retain the snap ring means in the body.

13. The latch of claim 10 additionally including biasing means interposed between the forward end region of the shank and the core of the outer plug means to bias the shank relatively rearwardly with respect to the body, and to bias the core of the outer plug means relatively forwardly with respect to the body for maintaining selected components of the assembly in engagement with each other and to prevent vibration and other unintended relative movement among the components of the assembly.

14. The latch of claim 13 wherein the three pieces of the assembly that comprise the outer plug structure, namely the pair of semi-circular sleeve halves and the generally cylindrical core, are provided with interfitting formation means for establishing a driving connection that will assure that these three pieces will rotate in unison within the body, but with the driving connection being inoperable to transmit axially oriented forces between any of these three pieces, whereby the action of the biasing means along the central axis that tends to bias the core forwardly with respect to the body will not serve to directly forwardly bias the sleeve halves, whereby the sleeve halves are free to axially position themselves within the body independently of the positioning of the core and independently of the positioning of each other, thereby minimizing tendencies of the various operating components to interfere with each other during operation of the latch.

15. The latch of claim 14 wherein the interfitting formation means that drivingly connects the sleeve halves and the core includes axially extending formations provided on each of the sleeve halves and the core, with the axially extending formations interfitting in an interleaved array about the perimeter of an imaginary circle that extends concentrically about the center axis.

16. A latch comprising:

(a) body means including a barrel shaped body for mounting the latch on a closure or the like, wherein:
  (i) the body has opposed front and rear end regions that are interconnected by a central portion having an outer surface;
  (ii) a passage is formed through the body and extends along an imaginary center axis that runs substantially centrally through the barrel shaped body, the passage defining an inner surface that is of substantially uniform inner diameter along its length except:
    (A) in the vicinity of the front end region wherein the passage defines a reduced diameter front end portion; and,
    (B) in the vicinity of the rear end region wherein the inner diameter of the passage is interrupted by a circumferentially extending groove that extends substantially concentrically about the central axis and faces radially inwardly; and,
  (iii) a pair of notches formed in the rear end region of the body and extending substantially radially with respect to the center axis, with each of the notches opening through the inner surface and the outer surface of the body, and with the notches extending axially along the barrel shaped body and intersecting with the circumferentially extending groove;

(b) radially compressible snap ring means of generally C-shaped configuration formed from resilient material and having peripheral portions that may be radially compressed to enable the snap ring means to be inserted into the rear end region of the body passage, with the peripheral portions being operable to seat in the circumferentially extending groove to retain the snap ring means in the body;

(c) an assembly of operating components that is carried by the body, with the assembly being insertable into the body passage through the rear end region thereof, and being retainable within the body passage by positioning the snap ring means so that its peripheral portions are seated in the circumferentially extending groove, and with the snap ring means being accessible through the rear end region of the body passage when the assembly is being retained in the body by the snap ring means, whereby the peripheral portions of the snap ring means may be radially compressed to enable the snap ring means and the assembly to be removed from the body through the rear end region of the body passage for lubrication, service and repair, the assembly including:
  (i) an elongate, generally cylindrical shank having a forward end region, a rearward end region, and an outer surface that interconnects the forward and rearward end regions, the shank being oriented to extend substantially concentrically along the center axis with its forward end region positioned within the body passage, with its outer surface extending from within the confines of the body passage and rearwardly out of the body passage, and with its rearward end region located rearwardly with respect to the body, the shank having a generally radially extending hole formed therethrough, with opposed ends of the hole opening through the outer surface of the shank at a location within the confines of the body passage;
  (ii) a pin having a central portion that is received by the hole formed in the shank, and having opposed end regions that project radially outwardly from the outer surface of the shank into close proximity with radially opposed portions of the inner surface of the body passage;
  (iii) inner plug means formed as a one-piece member that extends along the center axis and has forward and rearward ends, the inner plug means having:
    (A) a generally cylindrical sleeve portion having a substantially uniform outer diameter that extends concentrically about and axially along the center axis from the forward end of the inner plug means toward the rearward end thereof;
    (B) a relatively thin washer-like portion that defines the rearward end of the inner plug means, the washer-like portion being formed integrally with the sleeve portion and extending radially outwardly relative to the sleeve portion, the washer-like portion having peripheral portions that are configured to permit their being inserted into the body passage through the rearward end region of the body passage, and having a pair of opposed projections configured to be received by the notches formed in the body;
    (C) a hole formed through the sleeve portion and through the washer-like portion and having a substantially uniform inner diameter that extends along the center axis, the inner diameter of the hole being operable to journal the outer surface of the shank for rotation therein relative to the inner plug means; and,
    (D) a pair of generally L-shaped slots formed in the sleeve portion and opening through the inner diameter and the outer diameter of the sleeve portion, with each of the slots having first and second leg portions that extend substantially orthogonally relative to each other, with the first leg portions extending substantially axially with respect to the center axis, and with the second leg portions extending substantially circumferentially about the sleeve portion, and with the opposed end regions of the pin extending through the generally L-shaped slots;
  (iv) outer plug means formed as a three-piece assembly of interfitting parts that extends along the center axis and has forward and rearward ends, with the three pieces that form the outer plug means including a pair of substantially semi-circular sleeve halves and a generally cylindrical core, with the sleeve halves being arranged to form a tubular structure with portions thereof surrounding and interfitting with portions of the core to establish driving connections between the sleeve halves and the core, and with the sleeve halves and the core cooperating to define:
    (A) a generally cylindrical sleeve portion having a substantially uniform outer diameter that extends concentrically about and axially along the central axis from the rearward end of the outer plug means toward the forward end thereof, the uniform outer diameter of the outer plug means being of a size that enables it to be journaled for smooth rotation about the center axis by the inner diameter of the body;

(B) a relatively reduced diameter portion that defines the forward end of the outer plug means, the reduced diameter portion being formed integrally with the sleeve portion of the outer plug means and extending along the center axis into the reduced diameter forward end region of the body passage;

(C) a hole formed in the sleeve portion of the outer plug means and opening through the rearward end of the outer plug means, the hole having a substantially uniform inner diameter that extends along the center axis, the inner diameter being operable to journal the outer diameter of the inner plug means for rotation therein relative to the outer plug means;

(D) a pair of generally curved slots formed in the sleeve portion and opening through the inner diameter and the outer diameter of the sleeve portion of the outer plug means, with each of the curved slots defining cam surfaces that receive end regions of the pin; and, (E) operator engageable formation means connected to the outer plug means for enabling an operator to effect movement of the outer plug means relative to the body to operate the latch.

17. The latch of claim 16 additionally including biasing means interposed between the forward end region of the shank and the core of the outer plug means to bias the shank relatively rearwardly with respect to the body, and to bias the core of the outer plug means relatively forwardly with respect to the body for maintaining selected components of the assembly in engagement with each other and to prevent vibration and other unintended relative movement among the components of the assembly.

18. The latch of claim 16 wherein the three pieces of the assembly that comprises the outer plug structure, namely the pair of semi-circular sleeve halves and the generally cylindrical core, are provided with interfitting formation means for establishing a driving connection that will assure that these three pieces will rotate in unison within the body, but with the driving connection being inoperable to transmit axially oriented forces between any of these three pieces, whereby the action of the biasing means along the central axis that tends to bias the core forwardly with respect to the body will not serve to forwardly bias the sleeve halves, whereby the sleeve halves are free to axially position themselves within the body independently of the positioning of the core and independently of the positioning of each other thereby minimizing tendencies of the various operating components to interfere with each other during operation of the latch.

19. The latch of claim 18 wherein the interfitting formation means that drivingly connects the sleeve halves and the core includes axially extending formations provided on each of the sleeve halves and the core, with the axially extending formations interfitting in an interleaved array about the perimeter of an imaginary circle that extends concentrically about the center axis.

20. The latch of claim 16 wherein:

(a) threads are formed on at least a portion of the outer surface of the shank near the rearward end region thereof; and, (b) threaded mounting means is threaded onto the threads for securing the pawl means in place on the shank.

21. The latch of claim 20 wherein opposed planar drive surfaces are formed on the shank, and the pawl means has opposed planar formations that engage the opposed drive surfaces to drivingly connect the pawl means to the shank.

22. The latch of claim 16 wherein the operator engageable formation means includes tool receiving formation means for engaging a hand tool to enable the latch to be operated by the hand tool.

* * * * *